US007673474B2

(12) United States Patent
Athanasiou

(10) Patent No.: US 7,673,474 B2
(45) Date of Patent: Mar. 9, 2010

(54) REFRIGERATOR WITH INTEGRATED WATER SUPPLY

(75) Inventor: Athanasios Athanasiou, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 828 days.

(21) Appl. No.: 10/567,384

(22) PCT Filed: Aug. 10, 2004

(86) PCT No.: PCT/EP2004/008954

§ 371 (c)(1),
(2), (4) Date: Feb. 7, 2006

(87) PCT Pub. No.: WO2005/017426

PCT Pub. Date: Feb. 24, 2005

(65) Prior Publication Data

US 2006/0225454 A1 Oct. 12, 2006

(30) Foreign Application Priority Data

Aug. 11, 2003 (DE) ..... 103 36 832

(51) Int. Cl.
*F25D 11/00* (2006.01)

(52) U.S. Cl. ..... 62/440; 62/430

(58) Field of Classification Search ..... 62/440, 62/66, 21, 340, 430; 424/78.1
See application file for complete search history.

(56) References Cited

U.S. PATENT DOCUMENTS

| | | | | |
|---|---|---|---|---|
| 4,759,599 | A | 7/1988 | Yamaguchi | |
| 4,938,958 | A * | 7/1990 | Niira et al. | 424/78.1 |
| 6,101,833 | A | 8/2000 | Suzuki | |
| 6,571,573 | B1 | 6/2003 | Henry | |
| 2001/0027654 | A1 * | 10/2001 | Shapiro et al. | 62/1 |

FOREIGN PATENT DOCUMENTS

| | | |
|---|---|---|
| EP | 0 270 129 | 6/1988 |
| JP | 9 225457 | 9/1997 |
| JP | 11 132611 | 5/1999 |
| JP | 2000 258008 | 9/2000 |

OTHER PUBLICATIONS

International Search Report PCT/EP2004/008954.

* cited by examiner

*Primary Examiner*—Melvin Jones
(74) *Attorney, Agent, or Firm*—James E. Howard

(57) ABSTRACT

A refrigerator with a thermally insulated housing and integrated elements, suitable for the supply of potable water which can be connected to an external potable water supply. The surfaces of the integrated elements, provided for coming into contact with the potable water, are at least partly provided with a finish which is effective against microbes and/or fungi.

14 Claims, 1 Drawing Sheet

REFRIGERATOR WITH INTEGRATED WATER SUPPLY

The present invention relates to a refrigerator wherein integrated elements suitable for the supply of potable water, which can be connected to an external potable water supply are provided in a thermally insulated housing. Refrigerators of this type are known; the integrated elements can in particular comprise an automatic ice maker or parts thereof or a cooling device for potable water which are provided for connection to a potable water supply outside the refrigerator.

Containers for food or drinks normally remain in a refrigerator for only a few days until their contents are used up and they are rinsed before re-use so that no germs can normally collect in these containers. Water-carrying internal fittings of the type described above on the other hand are usually located permanently in the refrigerator and considerable effort is required to dismantle and clean them. In general, these internal fittings or at least parts thereof, continuously carry water regardless of whether they are used or not. This can have the result that bacteria, moulds or other fungi grow in these internal fittings and when the internal fittings are used, they can be rinsed out and taken up by a user.

It is the object of the present invention to provide a refrigerator wherein excessive multiplication of bacteria in the water-carrying internal fittings is prevented.

The object is solved by a refrigerator having the features of claim 1. The chemical equipment makes the surfaces of the internal parts unsuitable as carriers for bacteria, mould fungi etc; these are killed or their development is at least so largely inhibited that there is no hazardous multiplication for the user.

In order to keep the costs for equipment for preventing the growth of microbes and/of fungi low, preferably only a surface layer of an integrated element which comes in direct contact with potable water is loaded with a substance which is effective against microbes or fungi. Such a surface coating can especially be effectively-implemented with deep-drawn or extruded integrated elements.

In the case of small integrated elements or if the costs of the antibacterial equipment are not too high, it can be more economical to fabricate the integrated element in one piece from a material to which an anti-bacterially active substance has been applied. This particularly applies to injection moldings.

In both cases, the active substance is preferably embedded in a plastic matrix. Preferably used as active substances are silver compounds and/or zeolites in which metal ions effective against microbes and/or fungi, for example, silver, zinc, copper, are exchangeably bound. Zeolites of this type are described in EP 0 270 129 B1, synthetic resins loaded therewith in EP 0 228 063 B1.

Further features and advantages of the invention are obtained from the following description of an exemplary embodiment with reference to the appended figure.

Figure 1:
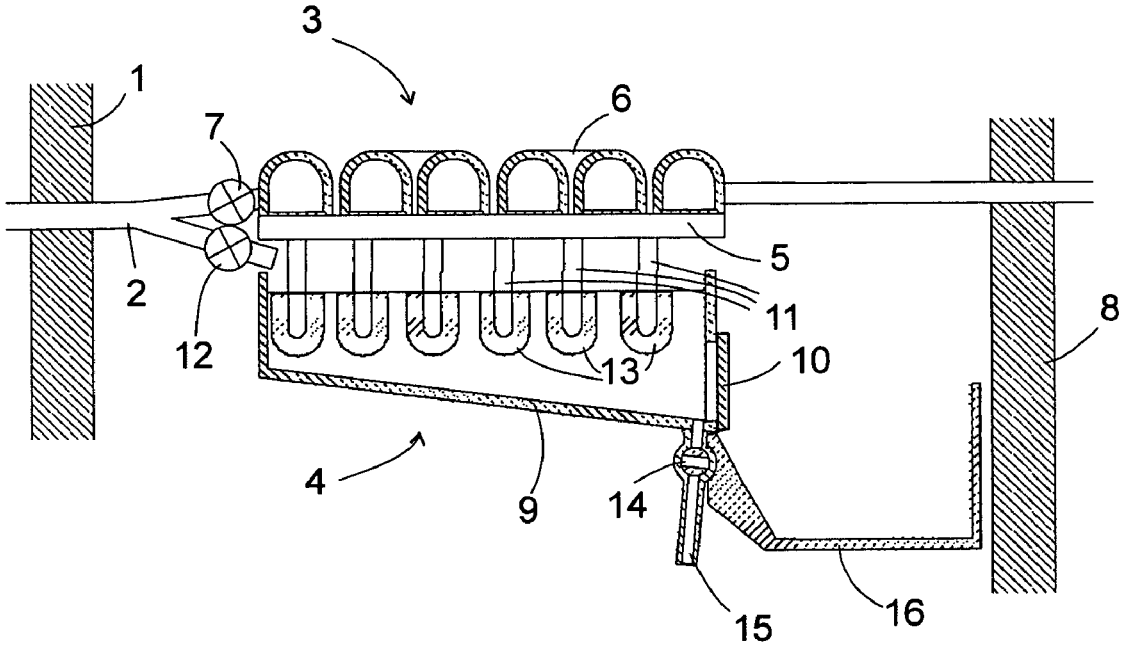
FIG. 1 shows an exemplary embodiment of a refrigerator with integrated water supply in accordance with the present invention.

This is a schematic diagram showing an automatic ice cube maker and dispenser for cooled potable water which is built into a refrigerator.

Passing through a first insulating wall 1 of the refrigerator is a fresh water pipe 2 which is connected to a potable water pipe (not shown) outside the appliance and which divides into two branches inside the appliance, one leading to a water cooler 3 and one to an ice maker 4.

The water cooler 3 is substantially formed by a heat exchanger comprising a cooling plate 5 through which the refrigerator coolant flows and a water pipe 6 is guided thereover in a meander fashion. An upstream end of the water pipe 6 is connected via a check valve such as a solenoid valve 7 to a fresh water pipe 2; its downstream end is guided through a second wall 8 of the housing to an exposed tap on the outside of the refrigerator. A switch (not shown) or sensor at the tap which responds to the presence of a container at the tap, switches the solenoid valve 7 open and closed so that water only flows through the pipe 6 and is cooled therein when a container is located at the tap. Since the solenoid valve 7 is located upstream of the water pipe 6, said water pipe is never under high pressure and can be formed cheaply of plastic for example.

This plastic is loaded with a material which releases a small quantity of silver ions, for example, with a silver-filled zeolite. Ions released to the water in the water pipe 6 prevent the growth of bacteria and fungi therein.

Since the water pipe 6 is not exposed to any high internal pressures, it can have comparatively thin walls which can be made completely of plastic material which releases silver ions. The fresh water pipe 2 which is at high pressure on the other hand, preferably has a multilayered structure comprising a silver-ion-releasing inner layer which can have the same composition as the water pipe 6 and surrounding pressure-resistant outer layer.

The ice maker 4 is substantially constructed of a freezer container 9, in this case a flat plastic shell with a sloping bottom and a flap 10 in a side wall at the lowest point of the freezer container 9, and a plurality of cooling fingers 11 through which the refrigerator coolant flows. The figure shows these cooling fingers 11 connected to the cooling plate 5 which is also part of the heat exchanger of the water cooler 3 and as part of the same coolant circuit as these, but the cooling fingers 11 can also be supplied with coolant independently of the water cooler 3.

One branch of the fresh water pipe 2 with a second solenoid valve 12 therein opens into the freezer container 9. Located on the freezer container 9 is a level sensor (not shown) which interrupts the water flow through the solenoid valve 12 when a predetermined maximum water level in the freezer container 9 is reached. Pieces of ice 13 form at the cooling fingers 11 which dip into the water. When these have reached a desired size or after a predetermined operating time of the ice maker, the water which is not frozen is drained from the freezer container 9 by opening a valve 14 in a drain pipe 15 and the cooling fingers 11 are heated, for example, using a built-in electric heater, to superficially begin to thaw the pieces of ice 13 and cause these to drop from the cooling fingers 11 onto the bottom of the now-empty freezer container 9. They then slide though the flap 10 which is then opened, into a collecting container 16 from where they can be removed. As soon as the flap 10 is closed again, water can be let into the freezer container 9 again to produce a new batch of ice pieces.

In the ice maker 4 the surfaces of the freezer container 9, the cooling fingers 11 or the collecting container 16 which come in contact with water or ice are especially provided with a bacteria-inhibiting finish comprising a material which releases silver ions or other suitable ions.

The invention claimed is:

1. A refrigerator, comprising:

a thermally insulated housing;

integrated elements in said housing suitable for the supply of potable water, which are configured for connection to an external potable water pipe through said housing including first integrated elements configured for operation at a first pressure and second integrated elements configured for operation at a second pressure, wherein the second pressure is higher than said first pressure; and wherein the first integrated elements are integrally formed from a material having at least one of anti-microbial property and an anti-fungal property and wherein the second integrated elements are coated with a material at least one of anti-microbial property and an anti-fungal property.

2. The refrigerator according to claim 1, including one of said integrated elements has a surface layer formed from a chemical substance effective against at least one of microbes and fungi and a carrier layer substantially free from said chemical substance.

3. The refrigerator according to claim 1, including one of said integrated elements integrally is formed of a material including a chemical substance effective against at least one of microbes and fungi.

4. The refrigerator according to claim 2, wherein said chemical substance is embedded in a plastic matrix.

5. The refrigerator according claim 2, wherein said chemical substance contains a silver compound.

6. The refrigerator according to claim 2, wherein said chemical substance contains a zeolite material in which metal ions effective against at least one of microbes and fungi are exchangeably bound.

7. The refrigerator according claim 2, wherein at least one of said integrated elements is one of a pipe, a freezer container or a heat exchanger.

8. A refrigerator, comprising:

a thermally insulated housing;

a plurality of integrated elements in said housing for the supply of potable water, connected to an external potable water pipe through said housing, at least one of said integrated elements is one of a pipe, a freezer container or a heat exchanger the plurality of integrated elements including first integrated elements configured for operation at a first pressure and second integrated elements configured for operation at a second pressure, wherein the second pressure is higher than said first pressure; and wherein the first integrated elements are integrally formed from a material having at least one of anti-microbial property and an anti-fungal property and wherein the second integrated elements are coated with a material at least one of anti-microbial property and an anti-fungal property.

9. The refrigerator according claim 8, wherein said integrated elements include a pipe coupled through a wall of said housing and separately coupled to a freezer container and a heat exchanger.

10. The refrigerator according to claim 9, wherein said pipe has a surface layer loaded with a chemical substance effective against at least one of microbes and fungi and a carrier layer substantially free from said chemical substance.

11. The refrigerator according to claim 9, wherein said freezer container and said heat exchanger are integrally formed of a material including a chemical substance effective against at least one of microbes and fungi.

12. The refrigerator according to claim 11, wherein said chemical substance substance is embedded in a plastic matrix.

13. The refrigerator according claim 11, wherein said chemical substance contains a silver compound.

14. The refrigerator according to claim 11, wherein said chemical substance contains a zeolite material in which metal ions effective against at least one of microbes and fungi are exchangeably bound.

* * * * *